United States Patent [19]

Daguerre

[11] 4,402,530

[45] Sep. 6, 1983

[54] FILE FOLDER WITH CLIPS

[76] Inventor: Gérard Daguerre, 775 Darveau St. - Apt. 3, Longueuil, Quebec, Canada, J4L 2V6

[21] Appl. No.: 295,656

[22] Filed: Aug. 24, 1981

[51] Int. Cl.[3] ..... B42F 13/14

[52] U.S. Cl. ..... 281/45; 282/29 R; 402/60; 402/80 R

[58] Field of Search ..... 281/45, 22, 26, 50; 282/29 C; 402/77, 62, 60, 26, 74, 73, 70, 75, 80 R, 80 P, 78, 79, 14, 15, 16; 40/360

[56] References Cited

U.S. PATENT DOCUMENTS

| | | | |
|---|---|---|---|
| 607,012 | 7/1898 | Boehner | 281/26 |
| 2,216,428 | 10/1940 | Best . | |
| 3,211,156 | 10/1965 | Dennis | 402/75 X |
| 3,362,411 | 1/1968 | Moller | 402/15 |
| 3,719,161 | 3/1973 | Wegner | 281/42 X |
| 3,797,146 | 3/1974 | Holes | 402/8 X |
| 3,970,397 | 7/1976 | Armstrong | 40/360 X |
| 4,135,832 | 1/1979 | Saltz | 402/15 |
| 4,174,909 | 11/1979 | Jahn | 402/75 X |

FOREIGN PATENT DOCUMENTS

| | | | |
|---|---|---|---|
| 520807 | 7/1953 | Belgium | 402/79 |
| 222706 | 10/1924 | United Kingdom | 402/79 |

*Primary Examiner*—Paul A. Bell
*Assistant Examiner*—John S. Brown

[57] ABSTRACT

There is described a file folder combined with spring type clips to hold a stack of sheets inside the folder. The top leaf of the folder is provided with openings through which one jaw of the clips is inserted. Each opening is large enough to clear the inserted jaw and also its operating arm, so that the top leaf may be fully open.

8 Claims, 6 Drawing Figures

FILE FOLDER WITH CLIPS

FIELD OF THE INVENTION

The present invention relates to folders used for containing and classifying sheets of paper, index cards and the like, more specifically to an improved folder of the above type which uses spring type clips.

BACKGROUND OF THE INVENTION

Known folders used by students, as well as professionals, for the orderly arrangement of paper, include binders, ring binders, folders using the tongue lock systems and variations thereof, etc. All of these folders have retaining means which necessitate at least one perforation in each sheet of paper or card which is to be placed therein. This constitutes a disadvantage, since it is necessary to perforate all the sheets of paper or cards, and often it is not desirable to have perforated sheets or cards.

OBJECTS OF THE INVENTION

Accordingly, it is a general object of the present invention to provide a folder adapted to retain a plurality of sheets of paper, or cards, without having recourse to perforations in the latter and which advantageously uses butterfly-type clips.

It is another object of the present invention to provide a folder of the above type, which is of simple and inexpensive construction.

SUMMARY OF THE INVENTION

The file folder of the invention comprises, in combination, a one-piece folder, made of stiff material and having top and bottom leaves and an intervening flexible interconnecting spine portion, and at least one standard spring type clip having a pair of jaws and a pair of operating arms. The file folder is provided with an opening in the top leaf adjacent the spine portion and extending into the latter. One jaw and its associated operating arm are inserted through said opening, while the other jaw overlies the bottom leaf, whereby the two jaws clamp the folder and a stack of paper sheets inserted into the folder. The top leaf can be opened, because the opening is large enough to clear said one jaw and its associated arm.

Retaining means are preferably provided on the back to prevent the clip from slipping off rearwardly.

It will be appreciated that the clip may be removed if the folder is to be classified with others in a filing cabinet or the like.

BRIEF DESCRIPTION OF THE DRAWINGS

The above will be more clearly understood by having referral to the preferred embodiments described hereinafter and illustrated, by way of the accompanying drawings, in which.

Like numerals refer to like elements throughout the drawings.

DETAILED DESCRIPTION OF THE INVENTION

Figure 1:
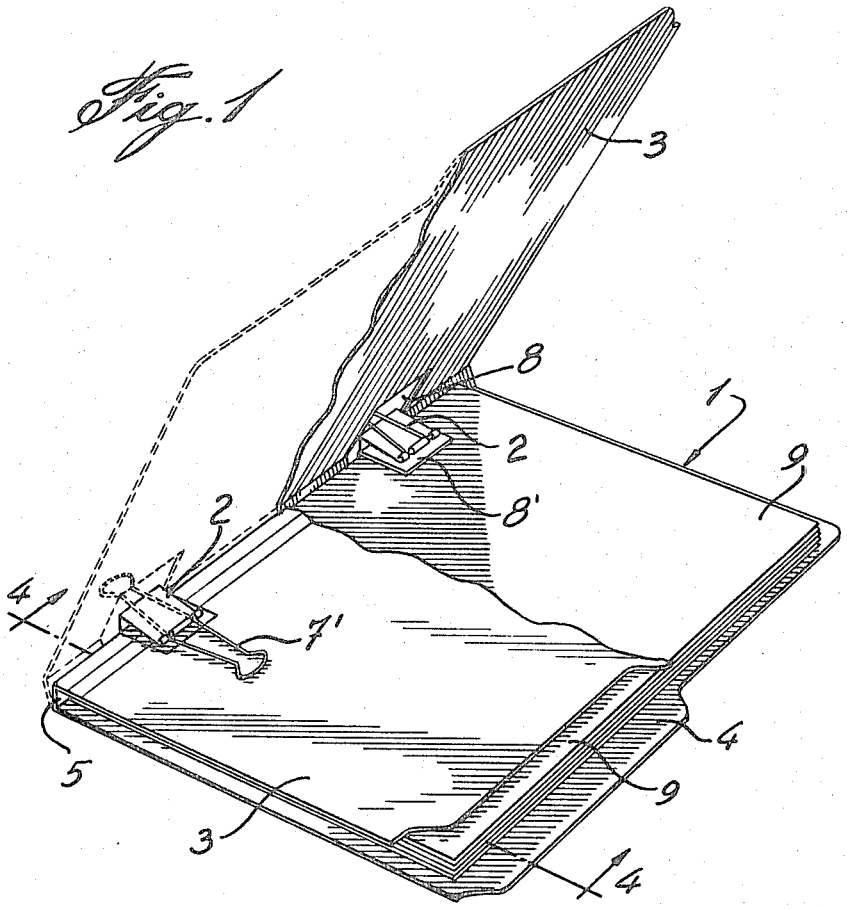
FIG. 1 is a perspective view of the folder showing two clips installed, with the top leaf shown fully closed and half-opened, and showing two ways of forming the opening in the top leaf.

The invention includes, in combination, a one-piece file folder, made of rigid or slightly flexible material, such as cardboard, and at least one standard spring type clip, such that the standard spring clip 2 provided with pivotable butterfly-shaped operating arms 7.

File folder 1 is formed of two top and bottom leaves 3 and 4 and an interconnecting spine portion 5 having multiple creases 5', in the known manner. Leaves 3 and 4 open from a closed overlying configuration to an open flat configuration.

Clip 2 is formed with a pair of jaws 6 and a pair of pivotal arms 7 by which the former can be open and closed, also in the known manner. Known spring clips with rigid operating arms could also be used, although more cumbersome.

Figure 4:
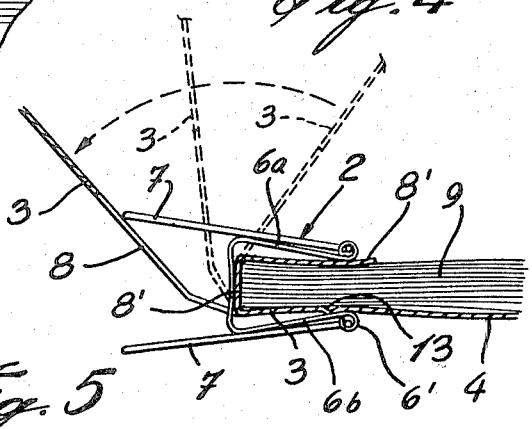
FIG. 4 is a cross-section taken along line 4—4 of FIG. 1 and showing the second retaining means.

According to a first embodiment of the invention, shown in the top part of FIG. 1 and in FIG. 4, the material of folder 1 is cut once longitudinally and twice transversely in spaced-apart relationship in top leaf 3 adjacent to and including spine portion 5, thus forming an opening 8 and a forwardly-extending tab 8'. A plurality of paper sheets, or cards 9, are placed inside the folder, such that their rear edge portions abut against the spine portion 5. It is then a simple matter to secure a spring type clip 2 to the tab 8' and to the bottom leaf with the paper sheets 9 between the leaves 3 and 4.

In a second or alternate embodiment of the invention, the tab 8' is completely removed, leaving the rectangular opening or cut-out 8. As shown clearly in the lower part of FIG. 1 and in FIGS. 2, 3, 5, and 6, the opening 8 includes the inner portion of top leaf 3 and all of the spine portion 5. A clip 2 is inserted through opening 8, so that top jaw **6*a* is clamped to sheets 9, while the bottom jaw 6*b* clamps the bottom leaf 4. In both embodiments, opening 8 is wider and deeper than top jaw 6*a* and its operating arm 7 with the latter in protruding operating position, so as to clear jaw 6*a* and arm 7 and thus permit free closing and opening of the top leaf, while clip 2** remains in clamping position.

In both embodiments, it is preferable that two spaced-apart clips 2 be used.

It will be appreciated that, since the operating arms 7 of clips 2 are pivotable, they can be placed in the forward inoperative 7' to eliminate protrusions at the spine portion 5 and permit classification of the folder and of its contents in a filing cabinet, while clips 2 remain attached to the folder and sheets. On the other hand, to further reduce the space occuped by the folders in the filing cabinet, clips 2 can be easily and conveniently removed. Obviously, the clips must be removed if they have non-pivotable operating arms.

Figure 2:
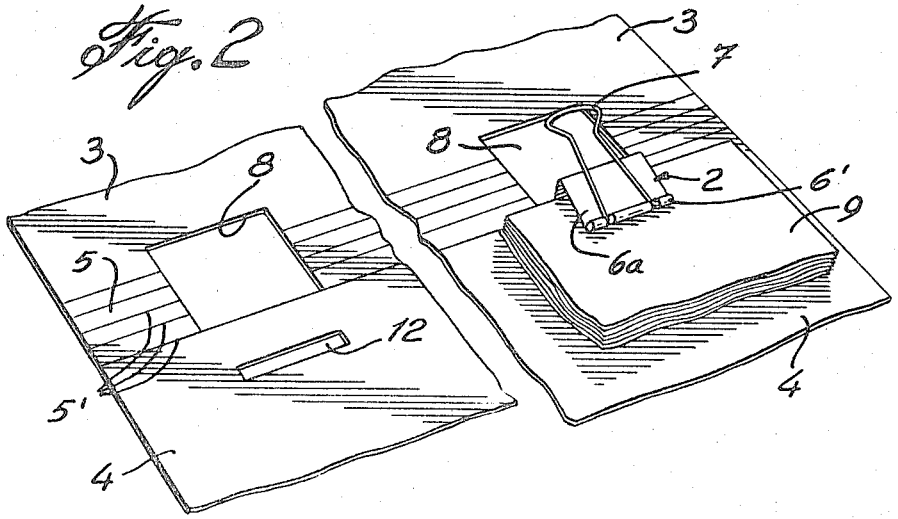
FIG. 2 is an exploded perspective view of the folder with the top leaf fully opened showing one manner of providing a retaining means on the bottom leaf.
Figure 3:
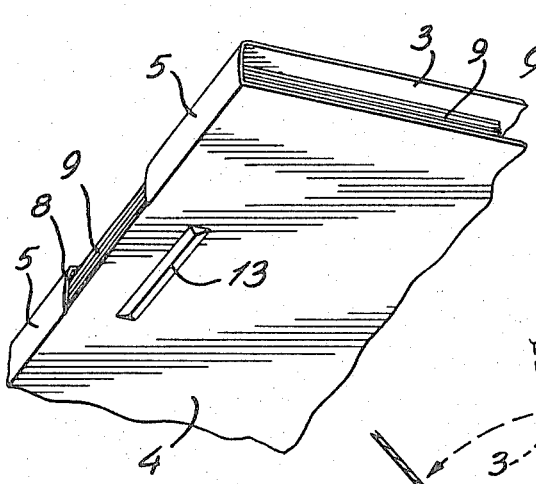
FIG. 3 is a bottom perspective view of the folder showing a second retaining means.
Figure 5:
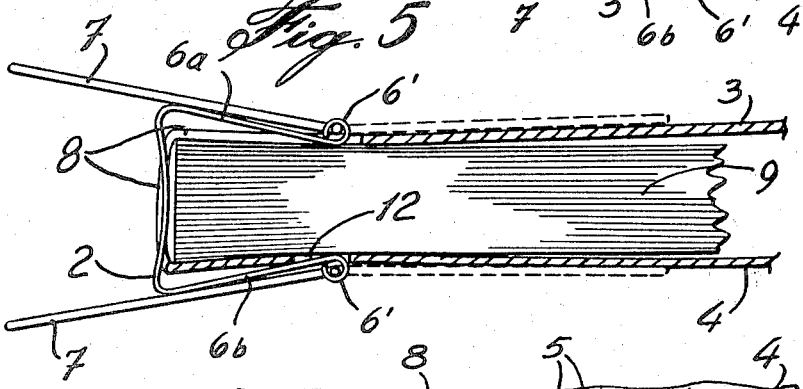
FIG. 5 is another cross-section taken along line 5—5 of FIG. 2, and showing the first retaining means.
Figure 6:
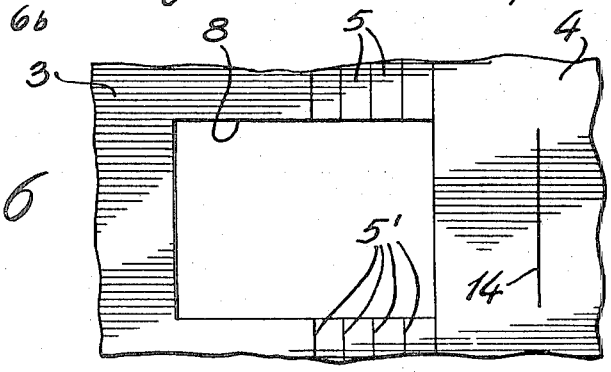
FIG. 6 is a top plan view of a portion of the folder in fully-opened condition and showing a third retaining means.

In order to ensure that clips 2 do not slide rearwardly, it is preferable to provide one of the three different retaining means illustrated. The first retaining means is shown in FIGS. 2 and 5 and consists of a narrow slot 12 formed in the bottom leaf 3. When a clip 2 is clamped into position, the leading edge 6' of the associated jaw 6 is adapted to fit into narrow slot 12 and directly contacts outermost sheet 9. The second retaining means is shown in FIG. 3, consisting of an embossed portion 13 in lieu of narrow slot 12. Embossed portion 13 protrudes from the outer surface of bottom leaf 4. The leading edge 6 of the associated jaw 6, in this case, is adapted to clap shut immediately forwardly of embossed portion 13, which then prevents any rearward slipping of clamp 2. The third retaining means is shown in FIG. 6, wherein slot 12 is replaced by a slit 14 disposed opposite clip leading edge 6'.

What I claim is:

1. A file folder comprising, in combination, a one-piece file folder having top and bottom leaves and an integral, flexible, interconnecting spine portion at the back of said leaves, and at least one standard spring type clip having a pair of spring-pressed jaws and pair of operating arms extending away from said jaws; said file folder being provided with an opening in the top leaf adjacent to said spine portion and extending into the latter; said opening being wider and deeper than one of said jaws and associated operating arm; said one jaw being inserted through said opening, while the other jaw overlies the bottom leaf, whereby the two jaws can clamp the folder and paper sheets inserted into said folder, and the top leaf can be operated because said opening clears said one jaw and associated arm.

2. A file folder as defined in claim 1, further comprising retaining means formed in said bottom leaf to engage the said other jaw and prevent rearward slipping of said clip.

3. A file folder as defined in claim 1, wherein there is a tab engaged by said clip, free from said opening along three edges thereof and retained to said folder longitudinally of said spine portion at the fourth edge of said opening.

4. A file folder as defined in claim 2, wherein said retaining means consists of a slit formed in the bottom leaf; said slit registering with the leading edge of said other jaw of said clip.

5. A file folder as defined in claim 2, wherein said retaining means consists of an embossed portion formed in the bottom leaf and retaining the leading edge of said other jaw immediately rearwardly thereof.

6. A file folder as defined in claim 2, wherein said retaining means consists of a narrow slot formed in the bottom leaf and receiving the leading edge of said other jaw.

7. A file folder as defined in claim 1, 2 or 3, wherein said operating arms are pivotally mounted on said clip.

8. The combination of a file folder with a spring clip, said file folder made of a one-piece sheet of stiff material and defining top and bottom leaves and an integral interconnecting spine portion at the back of said leaves, said folder having an opening made in said top leaf adjacent to said spine portion and extending into the latter, said folder adapter to receive a stack of sheets butting against said spine portion and said spring clip having jaws and operating arms extending away from said jaws in operative position, said spring clip, when in said operative position, retaining said folder and sheets together, with one jaw inserted through said opening, said opening being large enough to clear said one jaw and associated operating arm upon opening of said top leaf.

* * * * *